United States Patent [19]

Michels

[11] 4,100,741

[45] Jul. 18, 1978

[54] HOT-GAS ENGINE

[75] Inventor: Albertus Peter Johannes Michels, Eindhoven, Netherlands

[73] Assignee: U.S. Philips Corporation, New York, N.Y.

[21] Appl. No.: 780,702

[22] Filed: Mar. 24, 1977

[30] Foreign Application Priority Data

Apr. 6, 1976 [NL] Netherlands ..... 7603554

[51] Int. Cl.[2] ..... F02G 1/06

[52] U.S. Cl. ..... 60/517; 123/119 A; 431/115

[58] Field of Search ..... 60/516, 517, 524, 39.27, 60/39.28 T, 39.29, 278, 279; 123/119 A; 431/115, 116

[56] References Cited

U.S. PATENT DOCUMENTS

| | | | |
|---|---|---|---|
| 3,782,120 | 1/1974 | Brandenburg | 60/524 |
| 3,935,708 | 2/1976 | Harrewijne | 60/517 |
| 3,956,892 | 5/1976 | Nystrom | 60/517 X |

*Primary Examiner*—Allen M. Ostrager

*Attorney, Agent, or Firm*—Frank R. Trifari; David R. Treacy

[57] ABSTRACT

A hot-gas engine in which the supply of fuel to the burner device is controlled by means of a control signal which is derived from a differential pressure signal which represents the volume flow of combustion air and which is corrected for variations in temperature and pressure of the ambient air.

3 Claims, 1 Drawing Figure

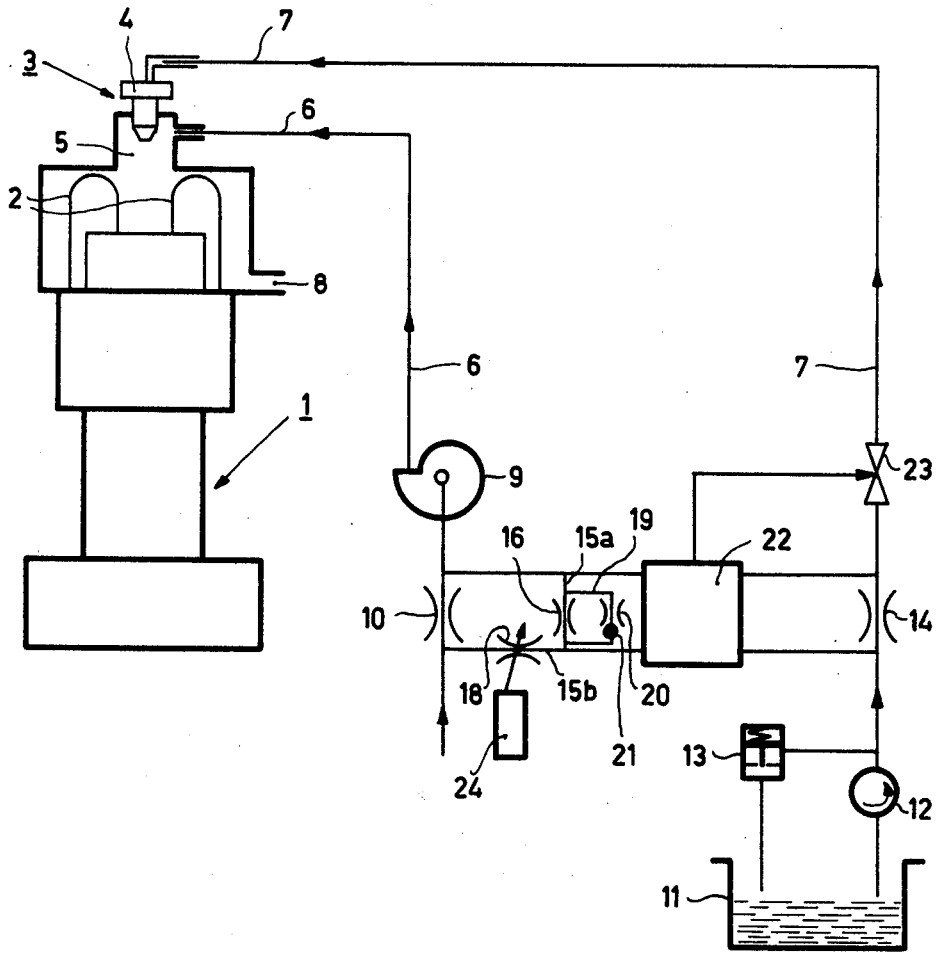
4
7
3
6
5
2
8
6
7
1
9
23
16
15a
19
22
10
14
18
15b
20
21
13
24
12
11

HOT-GAS ENGINE

The invention relates to a hot-gas engine, comprising at least one combustion chamber having connected to it at least one supply duct for combustion air, including a restriction, and at least one supply duct for fuel, the quantity of fuel to be supplied to the combustion chamber being controlled in proportion to the supplied quantity of combustion air by means of a control device which comprises a differential pressure sensor which communicates with the air supply duct upstream and downstream from the restriction.

A hot-gas engine of the kind set forth is known from Netherlands patent application No. 7,308,176 laid open to public inspection, to which U.S. Patent 3,935,708 corresponds notably from FIG. 1.

The pressure drop across the restriction detected by the sensor is a measure of the volume flow of air to the burner device. Variations in the temperature and the pressure of the ambient air, however, may substantially vary the air density. This means that, while the volume flow of air and the measured pressure drop remain constant, the mass flow (product of density and volume flow) of air to the burner device varies. As a result, the air/fuel mass flow ratio is undesirably disturbed.

The present invention has for its object to provide a hot-gas engine of the kind set forth in which the air/fuel mass flow ratio is corrected for the effect of ambient temperature variations and ambient pressure variations in a structurally simple manner.

In order to achieve this object, the hot-gas engine in accordance with the invention is characterized in that upstream and downstream from the restriction a branch duct is connected to the air supply duct, the branch duct comprising a first duct portion which includes a first flow resistance element and a second duct portion which includes a second flow resistance element, the differential pressure sensor being connected to the first duct portion upstream and downstream from the first flow resistance element, the second flow resistance element being subject to control means which, by controlling the flow resistance in response to variations of ambient air temperature and pressure, correct the differential pressure to be sensed by the sensor for the said variations.

In a preferred embodiment of the hot-gas engine in accordance with the invention, the first flow resistance element is adjustable.

This offers the advantage that the air fuel ratio which corresponds to the nominal operating conditions can be simply adjusted.

A further preferred embodiment of the hot-gas engine in accordance with the invention is characterized in that a third flow resistance element which is connected to the first branch duct portion upstream and downstream from the first flow resistance element can be switched on. When the third element is suitably proportioned, it is readily possible, without modification of the adjustment of the first flow resistance element, to temporarily decrease the differential pressure signal applied to the sensor. The fuel flow then decreases and the air/fuel ratio increases, which is desirable for starting the engine.

The invention will be described in detail hereinafter with reference to a drawing which shows a hot-gas engine comprising an air/fuel control system.

The reference numeral 1 in the FIGURE denotes a hot-gas engine in which a working medium performs a thermodynamic cycle in a closed working space during operation. Heat originating from a burner device 3 is applied to this working medium from the outside through the walls of a heater 2.

The burner device 3 comprises a burner 4, a combustion chamber 5, a supply duct 6 for combustion air and a supply duct 7 for fuel. Exhaust gases which have given off their heat to the heater 2 are discharged through the outlet 8.

The combustion air supply duct 6 includes, on the suction inlet side of a fan 9, a restriction 10, for example, a valve as shown in FIG. 3 of U.S. Pat. No. 3,935,708 cited above.

A fuel pump 12 supplies fuel from a fuel reservoir 11 to the combustion chamber 5. A relief valve 13 provides the desired pressure on the outlet of the fuel pump 12. The fuel supply duct 7 includes a restriction 14.

The combustion air supply duct 6 has connected to it, on either side of the restriction 10, a branch duct 15 comprising a duct portion **15*a*, including a flow resistance element 16, and a duct portion 15*b* which includes a flow resistance element 18**.

On either side of the flow resistance element 16, the duct portion **15*a* has connected to it an auxiliary duct 19 which includes a third flow resistance element 20 and a valve 21**.

During normal operation the valve 21 is closed and the pressure differences prevailing across the flow resistance element 16 and the restriction 14 are applied to a control device 22 which operates a control valve 23 in the fuel supply duct 7 in order to adapt the fuel flow to the combustion air flow in the duct 6.

The control device 22 may be constructed, for example, as shown in FIG. 3 of U.S. Pat. No. 3,780,528.

If the pressure difference across the restriction 10 is $\Delta P$, the flow resistance of the element 16 is $R_1$ and the flow resistance of the element 18 is $R_2$, the pressure difference applied to the control device 22 amounts to $$\Delta P_1 = [R_1/(R_1 + R_2)]\,\Delta P.$$

$\Delta P_1$ can be varied by varying the resistance $R_2$ of the element 18. This is effected by the control means 24 so that the signal derived from the restriction 10 and applied to the control device 22 through the flow resistance element 16 is corrected for variations in the air density which are caused by temperature and pressure variations.

The control means 24 comprise an assembly formed by a known pressure sensor and a known temperature sensor. The ambient pressure signals and ambient temperature signals measured are converted into electrical signals which control the element 18 which is constructed as a valve.

When the ambient temperature increases, the valve 18 is closed further, so that $R_2$ increases. The pressure drop $\Delta P_1$ across the element 16 then decreases, with the result that the mass flow of fuel also decreases. This is desirable because the higher ambient temperature causes a decrease of the air density and hence of the mass flow of air through the restriction 10. When the ambient temperature decreases, the valve 18 is opened further.

When the ambient pressure increases, the valve 18 is opened further, so that $R_2$ decreases and $P_1$ increases. The mass flow of fuel then also increases. This is necessary because a higher air pressure implies a higher density of the air flowing through the restriction 10. A larger mass flow of air is then accompanied by a larger mass flow of fuel, so that the air/fuel ratio remains constant. Conversely, the valve 18 is closed further if the ambient pressure decreases.

Obviously, a variety of alternatives are feasible. For example, the electrical control signal originating from the control means 24 can be used, for example, for controlling a heating element which heats the air flowing through the element 18, thus varying the resistance of the element 18.

The flow resistance element 16 is adjustable, so that the nominal desired air/fuel ratio can be adjusted.

The flow resistance element 20 has a resistance which is substantially lower than the adjusted resistance of the flow resistance element 16.

When the valve 21 is opened, the flow resistance element 16 is effectively short-circuited and the control device 22 receives a signal $\Delta P'_1$ which is smaller than $\Delta P_1$. As a result, the mass flow of fuel decreases. Thus, the air/fuel ratio can be temporarily increased, notably when the motor is started, without the nominally adjusted flow resistance element 16 being changed.

If desired, the flow resistance element 20 and the valve 21 can be combined to form one element.

What is claimed is:

1. A hot-gas engine, comprising at least one combustion chamber having connected to it at least one supply duct for combustion air, including a restriction, and at least one supply duct for fuel, the quantity of fuel to be supplied to the combustion chamber being controlled in proportion to the supplied quantity of combustion air by means of a control device which comprises a differential pressure sensor which communicates with the air supply duct upstream and downstream from the restriction, characterized in that upstream and downstream from the restriction a branch duct is connected to the air supply duct, said branch duct comprising a first duct portion which includes a first flow resistance element and a second duct portion which includes a second flow resistance element, the differential pressure sensor being connected to the first duct portion upstream and downstream from the first flow resistance element, the second flow resistance element being subject to control means which, by controlling the flow resistance in response to variations of ambient air temperature and pressure, correct the differential pressure to be sensed by the sensor for the said variations.

2. A hot-gas engine as claimed in claim 1, characterized in that the first flow resistance element is adjustable.

3. A hot-gas engine as claimed in claim 1, characterized in that a third flow resistance element which is connected to the first branch duct portion upstream and downstream from the first flow resistance element can be switched on.

* * * * *